US006044511A

United States Patent [19]

Frost et al.

[11] Patent Number: 6,044,511

[45] Date of Patent: Apr. 4, 2000

[54] CURB RAMP

[76] Inventors: Lois A. Frost; Charles E. Frost, both of 701 Wylly Ave., Sanford, Fla. 32773

[21] Appl. No.: 09/118,150

[22] Filed: Jul. 17, 1998

[51] Int. Cl.[7] ..... B66F 19/00

[52] U.S. Cl. ..... 14/69.5; 254/88

[58] Field of Search ..... 14/69.5; 254/88; 414/537

[56] References Cited

U.S. PATENT DOCUMENTS

| | | | |
|---|---|---|---|
| 1,726,988 | 9/1929 | Klein . | |
| 3,863,895 | 2/1975 | Grewe et al. | 254/88 |
| 3,917,227 | 11/1975 | West | 254/88 |
| 4,050,403 | 9/1977 | Miller | 254/88 |
| 4,108,421 | 8/1978 | Extine | 254/88 |
| 4,368,553 | 1/1983 | Perry | 14/69.5 |
| 5,033,146 | 7/1991 | Fogarty et al. | 14/69.5 |
| 5,287,580 | 2/1994 | Nelson | 14/71.3 |
| 5,483,715 | 1/1996 | Fogarty et al. | 14/69.5 |
| 5,599,235 | 2/1997 | Lynberg | 472/89 |
| 5,768,733 | 6/1998 | Kneebone | 14/69.5 |

*Primary Examiner*—James A. Lisehora
*Attorney, Agent, or Firm*—Edward M. Livingston, Esq.

[57] ABSTRACT

A portable curb ramp (1) for wheeled vehicles and equipment (4) having a curb conforming contact surface (7) and a planar road contact surface (6) on an underside and a sloping top surface (5) to allow tires (3) to transverse from a road surface up and over a curb (2). The sloping top surface (5) may have a plurality of transverse ridges (8) for improved traction. The underside curb conforming contact surface (7) may have a lip which extends over the top of the curb and one or more ridges (9) on the planar contact surface to reduce slippage of the ramp on a road surface. Magnets (13) attached to the planar contact surface allows the ramp to be secured to metal surfaces (14) on the wheeled vehicle and equipment so the ramp is readily accessible. The curb conforming contact surface (7) may have two low bearing side walls (16) with a hollow cutout (12) in between in order to reduce the weight of the ramp.

4 Claims, 2 Drawing Sheets

CURB RAMP

BACKGROUND OF THE INVENTION

This invention relates to portable ramps and more particularly, a ramp that allows the vehicles to traverse over curbs.

Wheeled vehicles, especially lawn care equipment, such as lawn mowers and tractors, are often required to traverse up and over curbs in order to get to grass cutting and work areas, such as those found in residential developments. Bumping against curbs to traverse up and over curbs causes wear and tear on such vehicles and equipment, often resulting in broken wheel casters on riding mowers, cracked transmissions, damaged cutting blades and damage to hydraulics. Some people use boards or other ramp-like devices in an attempt to eliminate the latter problems; however, boards and similar devices often break, slip or slide, are cumbersome and are usually not readily accessible when needed.

Thus, a need exists for a curb ramp that overcomes these problems.

The prior art includes several patents, but none like the present invention. U.S. Pat. No. 5,033,146 issued to Fogarty, et al. on Jul. 23, 1991 teaches a vehicle ramp with multiple inclines, but it cannot fit against a curb as the present invention. U.S. Pat. 5,287,580 issued to Nelson on Feb. 22, 1994, teaches a folding, portable hinged ramp with a flat top. U.S. Pat. No. 5,483,715 issued to Fogarty, et al. on Jan. 16, 1996, shows another vehicle service ramp. Finally, U.S. Pat. No. 5,599,235, issued to Lynberg on Feb. 4, 1997, shows a collapsible skate ramp with a sloped end.

Contrary to the above patents, the present invention, as described and illustrated in more detail herein, is a portable ramp having a curved bottom designed to allow it to hug the shape of a curve. The present invention has ridges on the top surface for traction and can have one or more ridges on a bottom surface for traction as well. Magnets may be attached to or embedded in the bottom surface so the ramp can be removably secured to metal on the top of wheeled vehicles and equipment so the ramp does not have to be hand carried and is readily available for use as needed.

SUMMARY OF THE INVENTION

The primary object of the present invention is to provide a device to enable wheeled equipment and vehicles to traverse up and over curbs.

Another object of the present invention is to eliminate the damage and stress to such equipment and vehicles which can result from traversing curbs.

A further object of the present invention is to provide such a ramp that does not slip or slide off a curb during use.

An even further object of the present invention is to provide such a ramp which has increased traction for wheels, particularly in wet conditions common to landscape maintenance.

An additional object of the present invention is to provide a ramp that does not have to be carried and is readily available for use as needed.

Further objects of the present invention include providing a curb ramp that is relatively lightweight and inexpensive.

The present invention fulfills the above and other objects by providing a portable ramp having a curb contact surface on an underside which conforms to the shape of the curb, such that a top lip fits over the top of the curb and a planar contact surface rests on the bottom. A sloping wheel-contact surface on the top side of the ramp extends from a lower end to the top of the curb. The wheel contact surface may have a plurality of transverse ridges at spaced intervals to provide better traction for tires of wheeled vehicles and equipment. The present invention also provides a means for attaching a ramp to wheeled vehicles and equipment, preferably magnetic means attached to or embedded in the flat contact surface on the underside of the ramp. To reduce the weight of the ramp, the curb contact surface may have a hollow cutout between two side walls that contact the curb.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 2:
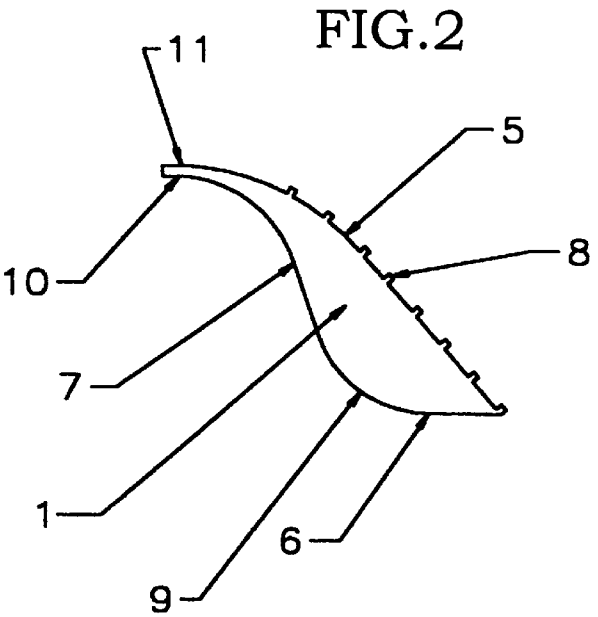
FIG. 2 is a side view of the curb ramp of the present invention.
Figure 1:
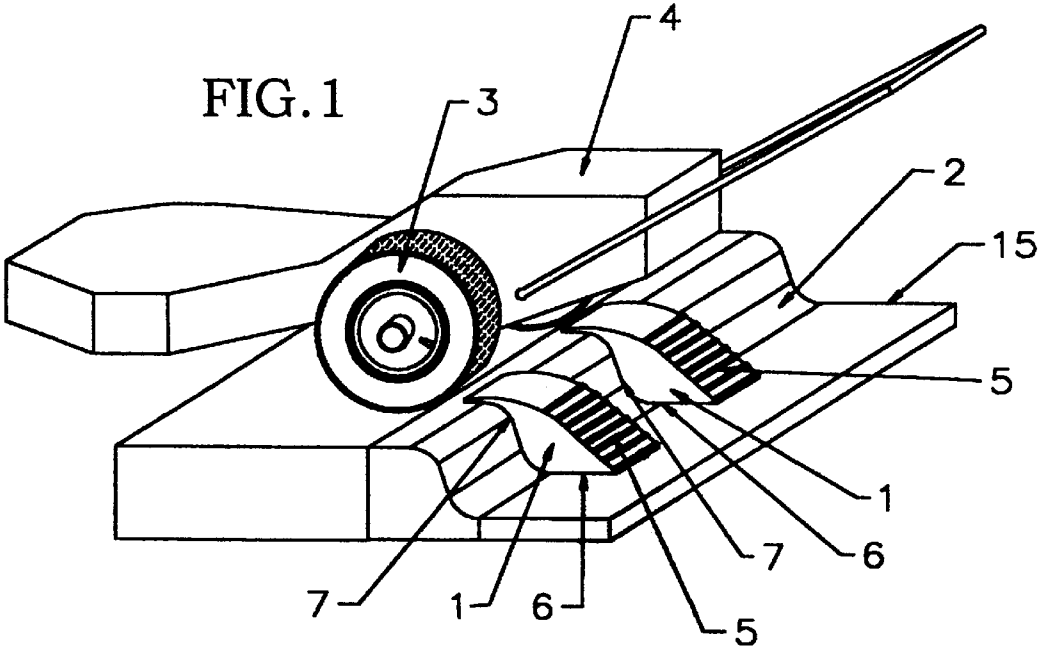
FIG. 1 is a perspective view of the curb ramp of the present invention as it would appear in use.

For purposes of describing the preferred embodiment, the terminology used in reference to the numbered components in the drawings is as follows:

1. curb ramp (invention)
2. curb
3. tires
4. lawn mower
5. top wheel contact surface
6. bottom ground/road contact surface
7. curb contact surface
8. wheel gripping traction ridges
9. bottom traction ridge
10. curb contact surface lip bottom
11. curb contact surface lip top
12. cutout
13. magnets
14. metal surface on lawnmower
15. road surface
16. side walls on curb contact surface Referring to FIG. 1, the curb ramp 1 is shown in actual use resting against a curb 2. A lawnmower 4 traverses the curb 2 by driving its tires 3 over the top wheel contact surface 5 of the curb ramp 1. The curb ramp 1 has a planar bottom 6 which rests on the road or other flat surface adjacent the curb 2. A curb contact surface 7 is curved so that it conforms to the contours of the curb 2. Most curbs have a substantially "S" shaped contour from top to bottom and thus, the curb contact surface 7 would likely be the contoured in the same shape.

FIG. 2 shows the curb ramp 1 by itself. The top surface 5 of the curb ramp 1 makes contact with the tire or wheel 3 of the vehicle or equipment 4 for which it is used.

A plurality of transverse ridges 8 may extend outward slightly from the top surface 5 to provide additional traction for the tires or wheels 4. A curb lip having a top 11 and a bottom 10 stretches over the top of the top of the curb to provide support and keep the curb ramp 1 from moving away from the curb 2. Additionally, one or more transverse ridges 9 may be molded on the bottom of the planar bottom surface 6 to also assist in keeping the curb ramp 1 from slipping or sliding away from a curb 2.

Figure 3:
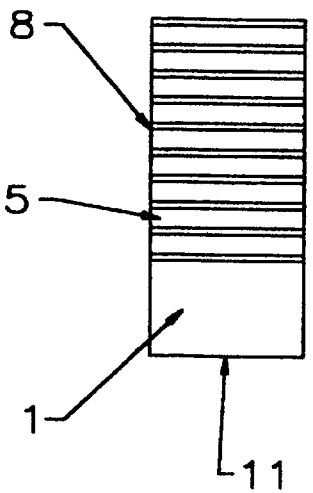
FIG. 3 is a top view of the curb ramp of the present invention.

FIG. 3 shows a top view of the curb ramp depicting the same components as discussed previously.

Figure 5:
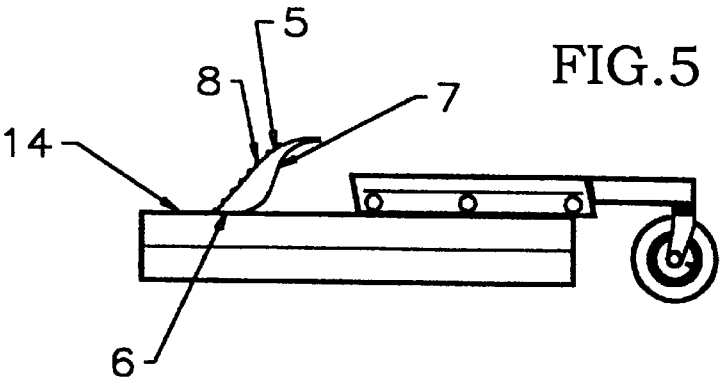
FIG. 5 is a side view showing the curb ramp of the present invention secured magnetically to a metal surface of a lawn mower.
Figure 4:
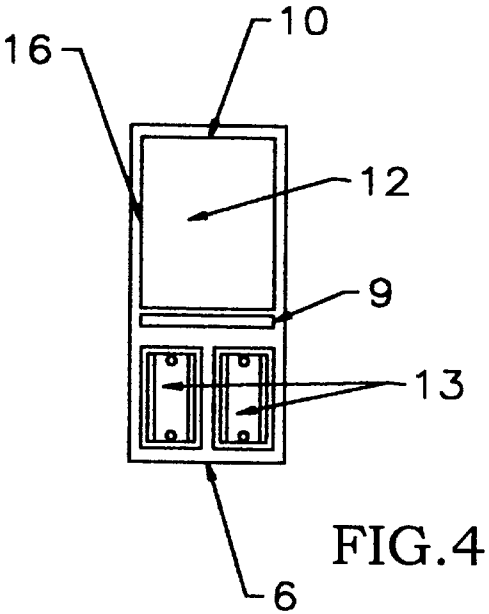
FIG. 4 is a bottom view of the curb ramp of the present invention showing magnetic attachment means and a weight reducing cutout.

As shown in FIG. 4, on the bottom of the curb ramp 1, magnetic attachment means 13 are attached to the bottom road contact surface 6. These magnets would preferably be powerful magnets which would enable the curb ramp 1 to be secured to the metal surface 14 of a vehicle as shown in FIG. 5. Although the attachment means could take many forms, such as brackets or Velcro® loop and fastening material, it preferably would consists of magnets 13 as shown. This latter attachment feature would make the curb ramp 1 easily accessible when needed and would prevent the user from having to carry the curb ramp 1 between uses. Further, as shown in FIG. 4, although the curb ramp 1 could be one solid piece of rigid material, such as plastic or rubber, to reduce weight without sacrificing strength, a hollow cutout 12 could be made in the curb contact surface 1 with side walls 16 to contact the curb.

Although only a few embodiments of the present invention have been described in detail hereinabove, all improvements and modifications to this invention within the scope or equivalents of the claims are covered by this invention.

Having thus described our invention, we claim:

1. A portable ramp for allowing wheeled vehicles and equipment to traverse a curb comprising:

a curb contact surface on an underside of the ramp having a shape which substantially conforms to a top surface of the curb, said curb contact surface extending from a top of the curb to a planar contact surface at a bottom;

a planar contact surface on the underside of the ramp at the bottom of the curb contact surface;

a sloping wheel contact surface on a top side of the ramp extending from a bottom to a top of the curb; and means for removably securing the ramp to wheeled vehicles and equipment comprising at least one magnet attached to the planar contact surface on the underside of the ramp.

2. The portable ramp of claim 1 further comprising a plurality of transverse ridges at spaced intervals on the wheel contact surface to provide better traction for tires of wheeled vehicles and equipment.

3. The portable ramp of claim 2 further comprising at least one transverse ridge on the planar contact surface to provide better gripping to road surfaces.

4. The portable ramp of claim 1 further comprising at least one transverse ridge on the planar contact surface to provide better gripping to road surfaces.

* * * * *